United States Patent [19]

Wright et al.

[11] Patent Number: 4,474,232

[45] Date of Patent: Oct. 2, 1984

[54] HEAT EXCHANGE UNIT FOR BOTH VERTICAL AND HORIZONTAL APPLICATIONS

[75] Inventors: Timothy A. Wright, Chittenango; Thaddeus J. Wawro, Auburn; Donald J. Casler, Syracuse, all of N.Y.

[73] Assignee: Carrier Corporation, Syracuse, N.Y.

[21] Appl. No.: 279,655

[22] Filed: Jul. 2, 1981

[51] Int. Cl.[3] ..... F28F 7/00

[52] U.S. Cl. ..... 165/137; 165/78; 62/288

[58] Field of Search ..... 165/137, 78; 62/285, 62/286, 291, 288, 290, 298, 299

[56] References Cited

U.S. PATENT DOCUMENTS 3,299,660 1/1967 Sullivan ..... 62/285
3,596,475 8/1971 Berger ..... 62/285
3,882,690 5/1975 Duell et al. .
3,902,551 9/1975 Lim et al. .
4,129,013 12/1978 Hine, Jr. ..... 62/285

*Primary Examiner*—William R. Cline
*Assistant Examiner*—John F. McNally
*Attorney, Agent, or Firm*—David J. Zobkiw

[57] ABSTRACT

A heat exchange unit is disclosed which is capable of being mounted either in a vertical or horizontal position. A condensate pan including multiple drain openings each serving a particular position is additionally disclosed. A cover plate secures the condensate pan by providing a drain projection opening into which a projection from the condensate pan may extend. A drip pan for coacting with the condensate pan is provided when the unit is mounted in the horizontal position.

6 Claims, 4 Drawing Figures

HEAT EXCHANGE UNIT FOR BOTH VERTICAL AND HORIZONTAL APPLICATIONS

BACKGROUND OF THE INVENTION

1. Field of the Invention

The present invention relates to heat exchange units which are capable of being mounted in either vertical or horizontal applications. More specifically, the present invention relates to an evaporator assembly for use in a heat exchange unit including a condensate pan having multiple drain openings, each being the primary drain in either the vertical or horizontal position.

2. Description of the Prior Art

Heat exchange assemblies having a casing defining an air flow path and a fan for moving the air along said air flow path have long been known in the art. In order to reduce the number of models of heat exchange units supplied by manufacturers it is desirable to produce units which may be mounted either in vertical or horizontal positions. Typical of such a fan coil unit application would be the indoor or evaporator unit of an air conditioning system used for absorbing heat energy from the air of an enclosure. In such a unit the evaporator is mounted in heat exchange relation with the air flowing through the unit and heat energy is absorbed by the refrigerant flowing through the evaporator from the air flowing thereover. As the air is cooled, moisture is often condensed on the surfaces of the evaporator.

With a fan coil unit capable of being mounted in either a horizontal or vertical application it is necessary that means be provided for collecting condensate from the evaporator in both positions. Previous units have used condensate collection pans located at the bottom of the coil in both applications for receiving said condensate. These previous systems, although some have used multiple openings for the discharge of the condensate, have not incorporated a condensate pan wherein the drain opening serving a particular application changes between horizontal and vertical applica- tions.

Additionally, as set forth herein, a condensate pan having a projection with multiple openings is described. This condensate pan projection extends through a cover plate of the unit which not only serves to provide a structural function for the unit but encases the end of the drain projection to secure the condensate pan and attached evaporator relative to the unit.

SUMMARY OF THE INVENTION

An object of the invention is to provide a heat exchange unit having condensate collection means.

It is a further object of the present invention to provide a condensate pan capable of receiving condensate from the evaporator in both the vertical and horizontal positions.

A still further object of the present invention is to provide means for securing a condensate pan relative to the casing of an air conditioning unit.

A further object of the present invention is to provide a safe, economical and reliable method of assembling an air conditioning unit.

Other objects will be apparent from the description to follow and from the appended claims.

The preceeding objects are achieved according to the preferred embodiment of the invention by the provision of a heat exchange unit capable of being mounted either horizontally or vertically including a casing defining an air flow path. The heat exchanger is mounted diagonally across the air flow path to transfer heat energy between fluid flowing through the heat exchanger and air flowing along the air flow path. A condensate pan is mounted to the lower end of the heat exchanger to receive condensate from the heat exchanger, said condensate pan including a projection defining a first drain opening and a second drain opening, the first drain opening being located at the bottom level of the condensate pan when the unit is in the horizontal position and the second drain opening being located at the bottom level of the condensate pan when the unit is in a vertical position. Means to secure the condensate pan and the attached heat exchanger relative to the casing, including a cover plate defining a drain opening, for receiving the drain projection of the condensate pan are disclosed. Brackets for supporting the upper end of the heat exchanger by securing the tube sheets of the heat exchanger to the casing are additionally disclosed. A drip pan may additionally be used when the heat exchanger is mounted in the horizontal position, said drip pan receiving condensate from the evaporator and conducting same to the condensate pan.

DESCRIPTION OF THE PREFERRED EMBODIMENT

The embodiment described herein will be for use in a fan coil unit of an air conditioning system. It is to be understood that this fan coil unit, although described as an evaporator, could likewise be the indoor coil of a heat pump or the heat exchanger of some other application where air is being cooled.

Figure 1:
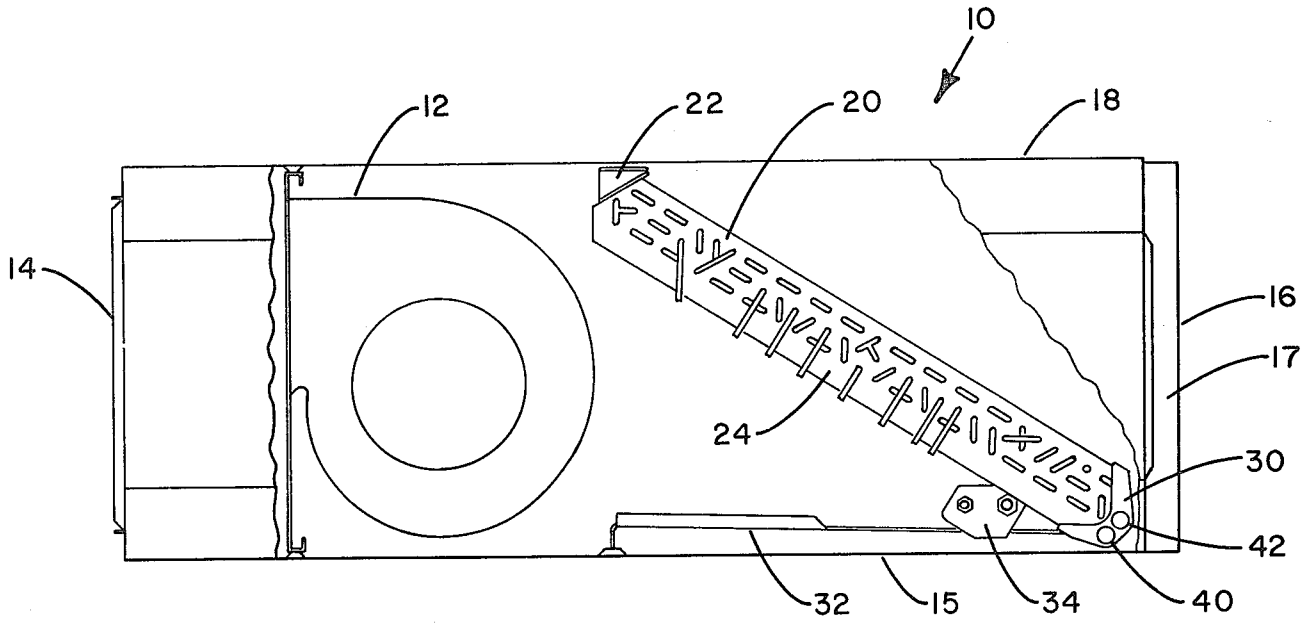
FIG. 1 is a cutaway side view of a fan coil unit including an evaporator and condensate pan.

Referring to FIG. 1, it can be seen the unit 10 includes fan 12, evaporator 20 and casing 18. Casing 18 defines an air flow portion including air intake 16 and air discharge 14. Fan 12 acts to draw the air to be conditioned through air intake 16 over the surfaces of the evaporator 20 and discharge the same through air discharge 14. Casing 18 defines the structure of unit 10 and includes base portion 17 and side wall 15. Evaporator 20 has tube sheet 24 at an end thereof and numerous tube openings and connections such as return bends and tripods located at the edge thereof. Condensate pan 30 is located at the lower end of evaporator 20 and has first drain opening 40 and second drain opening 42 at the end thereof. Bracket 22 is mounted at the upper end of evaporator 20 connecting tube sheet 24 to casing 18. Retainer 34 is mounted to the tube sheet towards the lower end of evaporator 20 and extends downwardly therefrom. Drip pan 32 extends across the bottom surface of the unit and is located to receive condensate falling from the evaporator and to conduct said condensate to the condensate pan 30 when the unit is mounted in a horizontal application.

Figure 2:
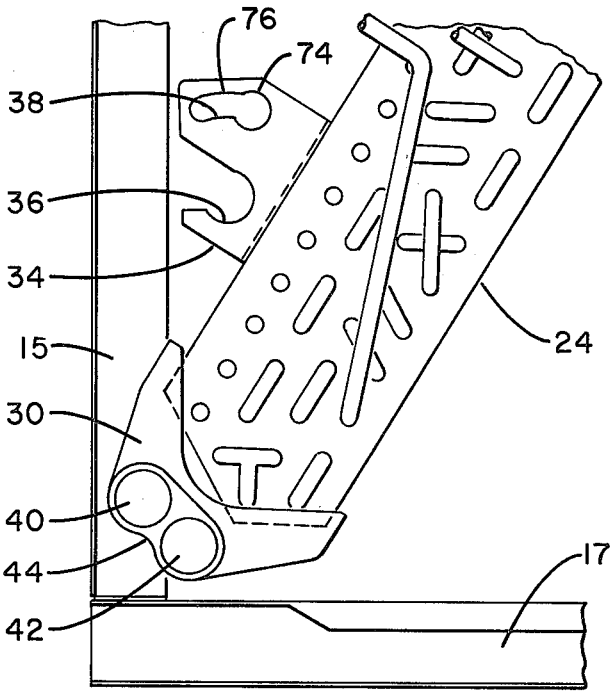
FIG. 2 is a cutaway view of a portion of the heat exchanger and condensate pan shown mounted in the vertical position.

FIG. 2 shows a portion of the unit with the unit being mounted in the vertical position. In this view it may be seen that retainer 34 extends from the tube sheet and includes therein suction line opening 36 and liquid line slot 38, the liquid line slot having a curvilinear tail portion 76 and a head portion 74. Tube sheet 24 extends into condensate pan, 30 having first drain opening 40 and second drain opening 42 formed in drain projection portion 44. Side wall 15 and base portion 17 are additionally shown.

Figure 3:
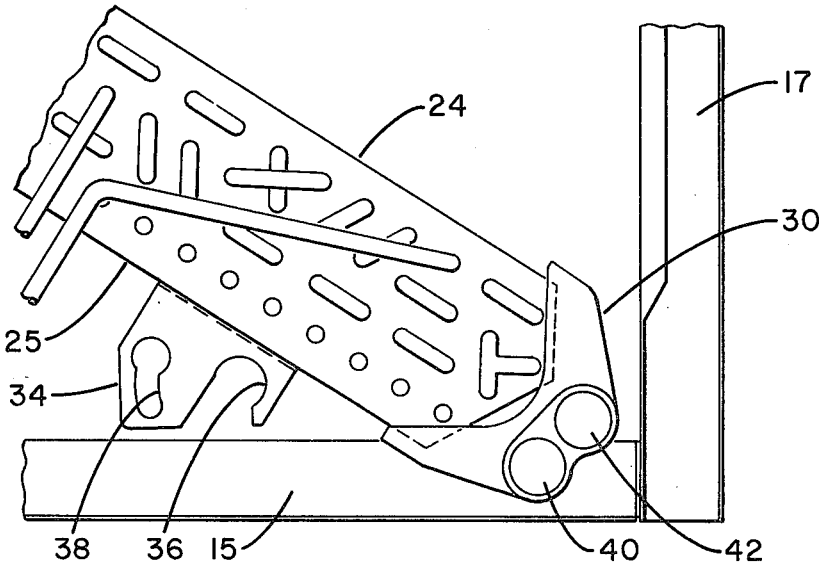
FIG. 3 is a cutaway view of a portion of the condensate pan and heat exchanger shown mounted in the horizontal position.

FIG. 3 is an identical view to FIG. 2 with the unit mounted in the horizontal position. In this position it may be seen that first drain opening 40 is located at the bottom level of the condensate pan whereas in the previous view, FIG. 2, the second drain opening 42 is located at the bottom level of the condensate pan. The remaining components of the unit are identical to the previous figure. Flange 25 of tube sheet 24 is specifically referenced to indicate the manner in which retainer 34 is secured thereto.

Figure 4:
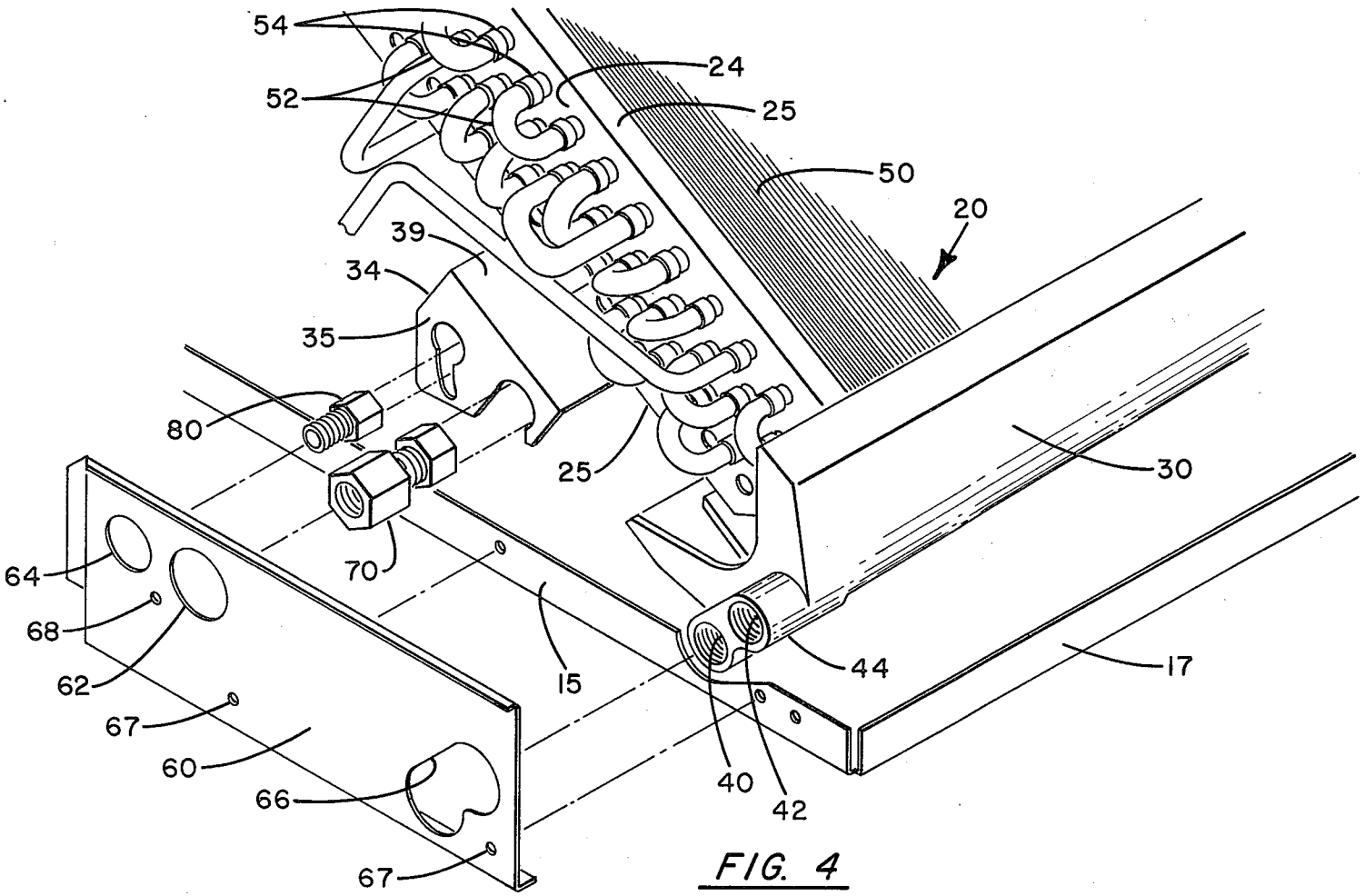
FIG. 4 is a perspective view of a portion of the fan coil unit showing the condensate pan, heat exchanger and cover plate with the heat exchanger being mounted in the horizontal position.

FIG. 4 is a perspective view of a portion of the unit including the plate and couplings. As may be seen in FIG. 4, condensate pan 30 is a generally trough-shaped longitudinally extending container having drain projection 44 extending from the end thereof. First drain opening 40 and second drain opening 42 are shown formed as threaded openings in drain projection 44. It is contemplated that a drain line for conducting condensate from the unit to a disposal location will be connected to one of these openings and the other may be plugged or left open as a secondary overflow drain.

Retainer 34 is shown having front portion 35 defining liquid line slot 38 and suction line opening 36 and extension portion 39 extending to flange 25 of tube sheet 24. Liquid header coupling 80 is shown as it would be assembled to the unit as is suction header coupling 70. The headers from the coil would be secured with the liquid header being secured to the liquid header coupling 80 and the suction header being secured to suction header coupling 70 such that the piping of the unit would form a closed circuit between the couplings 70 and 80. The liquid line coupling is sized having a diameter greater than the suction line opening such that the liquid line coupling is snapped into position.

Cover plate 60 is shown for attachment to the casing of the unit. Cover plate 60 defines a liquid line opening 64, suction line opening 62, drain projection opening 66 and has mounting holes 67 and retainer fastener hole 68. As seen in this exploded view it is apparent that the cover plate, when assembled, acts to engage the drain projection 44 in drain projection opening 66 securing the condensate pan in the appropriate position. Likewise, suction header coupling 70 is secured in suction line opening 36 of the retainer and in suction line opening 62 of the cover plate to secure the retainer relative to the cover plate. Liquid header coupling 80 likewise extends through the liquid line slot 38 of the retainer and liquid line opening 64 of the cover plate to additionally provide support for the unit. A screw may be inserted through retainer fastener hole 68 in the cover plate into the retainer to provide additional support.

When the cover plate is assembled to the casing the cover plate secures drain projection 44 and retainer 34. In the assembled position, the couplings extend through suction line opening 62 and liquid line opening 64 such that the refrigerant connections to the remainder of the refrigeration circuit may readily be made thereto.

As shown in FIGS. 2 and 3, the identical heat exchange unit may be mounted in a horizontal or vertical position using the cover plate as shown. To promote interchangeability of parts between various heat exchange units it is desirable to have heat exchangers capable of being mounted at different angles within the units and having different lengths, sizes and other parameters. The condensate pan, as shown, may be utilized with various size heat exchangers and mounted at various angles. By providing a retainer secured to the tube sheet flange various heat exchangers may be mounted at different angles.

The retainer defines liquid line slot 38 and suction opening 36. When suction header 70 and liquid header 80 are mounted to the retainer, the heat exchanger is capable of movement relative to the casing such that the heat exchanger may be secured in different locations. The suction header serves as a pivot and the liquid header may be secured in any position along liquid line slot 38. Hence, to provide different heat exchanger arrangements, a different mounting may be provided by merely changing cover plate 60. The cover plate is changed to reposition liquid line opening 64, suction line opening 62 and the angle at which drain projection opening 66 secures the condensate pan. By changing these angles or locations of the cover plate it is possible to utilize the same heat exchanger retainer and condensate pan for various heat exchange units. The same condensate pan and retainer may also be used with heat exchangers of varying dimensions.

The condensate pan may be secured to the tube sheets of the heat exchanger by providing various projections and embossments in the condensate pan. For details of similar attachment methods see U.S. Pat. No. 3,882,690.

When the unit is mounted in the vertical position the condensate collected on the fins tends to flow downwardly along the fins. The condensate drips off the bottom of the fins into condensate pan 30. When the unit is mounted in the horizontal position as shown in FIG. 1 the condensate also tends to flow along the fin surface in a downwardly direction from the end of the heat exchanger adjacent bracket 22 towards the condensate pan. Since the angle of the heat exchanger from vertical when the unit is in the horizontal position is less than when the unit is in the vertical position some condensate may fall from the fins rather than flowing downwardly along the fins. Drip pan 32 is positioned to collect this condensate that falls and to conduct the condensate to condensate pan 30.

The invention herein has been described in detail with particular reference to the preferred embodiment thereof, but it will be understood that variations and modifications can be effected within the spirit and scope of the invention.

What is claimed is:

1. A heat exchange unit capable of being mounted either horizontally or vertically which comprises:

a casing defining an air flow path;

a heat exchanger fixedly mounted across the air flow path to transfer heat energy between a fluid flowing through the heat exchanger and the air flowing along the air flow path;

a condensate pan mounted to the lower end of the heat exchanger to receive condensate from the heat exchanger, said condensate pan including a single projection defining both a first drain opening and a second drain opening, the first drain opening being located at the bottom level of the condensate pan when the unit is in the horizontal position and the second drain opening being located at the bottom level of the condensate pan when the unit is in the vertical position; and means to fixedly secure the condensate pan and the connected heat exchanger relative to the casing and including a cover plate secured to the casing and defining a drain projection opening sized to receive and fixedly position the drain projection of the condensate pan whereby the cover plate and drain projection coact to fixedly position the condensate pan and heat exchanger.

2. The apparatus as set forth in claim 1 and further comprising a drip pan mounted to the casing such that the drip pan is positioned below the heat exchanger when the unit is in the horizontal position, said drip pan being angled to conduct collected condensate into the condensate pan.

3. The apparatus as set forth in claim 1 wherein the heat exchanger has a tube sheet mounted on each side thereof and bracket means comprising a pair of brackets each connecting a tube sheet at the end of the heat exchanger distant from the condensate pan to the casing.

4. An evaporator assembly for use with an air conditioning system, said evaporator assembly being designed for vertical or horizontal applications and comprising:

a casing defining an air flow path for air to be cooled by the air conditioning system;

a plate fin type evaporator fixedly angled across the air flow path defined by the casing, said evaporator having refrigerant flowing therethrough for absorbing heat energy from the air flowing along the air flow path;

said evaporator having fins angled from the air flow path upon which condensate from the air being cooled may collect;

a condensate pan fixedly mounted to the lower end of the evaporator such that condensate collected on the fins may flow along the fins of the evaporator to the condensate pan;

said condensate pan including a single drain projection defining both a first drain opening and a second drain opening, the first drain opening being located at the bottom level of the condensate pan when the assembly is in the horizontal position and the second drain opening being located at the bottom level of the condensate pan when the assembly is in the vertical position; and means to fixedly secure the condensate pan relative to the casing and including a cover plate secured to the casing and defining a drain projection opening into which the drain projection of the condensate pan may be engaged to fixedly position the drain projection and thereby the condensate pan and evaporator.

5. The apparatus as set forth in claim 4 and further comprising a drip pan mounted to the casing beneath the evaporator when the assembly is in the horizontal position, said drip pan being positioned to receive condensate from the fins of the evaporator that does not flow along said fins and said drip pan extending to the condensate pan for conducting condensate thereto.

6. The apparatus as set forth in claim 4 wherein the evaporator has tube sheets extending along the length of each end thereof and further comprising brackets mounted to the tube sheets to secure the upper end of the evaporator to the casing.

* * * * *